US010119436B2

(12) United States Patent
Miyasaka et al.

(10) Patent No.: US 10,119,436 B2
(45) Date of Patent: Nov. 6, 2018

(54) INTERNAL COMBUSTION ENGINE

(71) Applicant: TOYOTA JIDOSHA KABUSHIKI KAISHA, Toyota-shi, Aichi-ken (JP)

(72) Inventors: Katsuichi Miyasaka, Gotemba (JP); Satoko Tofukuji, Tokyo-to (JP); Kenji Ikeda, Gotemba (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/618,755

(22) Filed: Jun. 9, 2017

(65) Prior Publication Data

US 2017/0356315 A1 Dec. 14, 2017

(30) Foreign Application Priority Data

Jun. 13, 2016 (JP) ..... 2016-116854

(51) Int. Cl.

| | |
|---|---|
| ***F01M 1/06*** | (2006.01) |
| ***F01M 11/00*** | (2006.01) |
| ***F01L 1/053*** | (2006.01) |
| ***F01L 1/344*** | (2006.01) |
| ***F01M 1/12*** | (2006.01) |
| *F01M 1/08* | (2006.01) |
| *F01L 1/047* | (2006.01) |

(52) U.S. Cl.

CPC ..... *F01M 11/0004* (2013.01); *F01L 1/053* (2013.01); *F01L 1/344* (2013.01); *F01M 1/12* (2013.01); *F01L 2001/0476* (2013.01); *F01L 2001/0537* (2013.01); *F01M 1/08* (2013.01); *F01M 2011/0037* (2013.01); *F01M 2011/0054* (2013.01)

(58) Field of Classification Search

CPC .... F01L 1/053; F01L 2001/0476; F01M 1/08; F01M 11/0004; F01M 2011/0054

USPC ..... 123/90.16, 90.31, 90.33, 90.34

See application file for complete search history.

(56) References Cited

U.S. PATENT DOCUMENTS 8,051,820 B2 * 11/2011 Shoji ..... F01L 1/053 123/90.33

FOREIGN PATENT DOCUMENTS

| | | | |
|---|---|---|---|
| JP | H08-246831 | A | 9/1996 |
| JP | 2011-190721 | A | 9/2011 |

* cited by examiner

*Primary Examiner* — Ching Chang

(74) *Attorney, Agent, or Firm* — Hunton Andrews Kurth LLP

(57) ABSTRACT

Side surfaces of an end cam cap and a pair of side surfaces of a recess for cam cap form two cross-sectional area gradually changing gaps therebetween. A gasket is filled between an inner surface of the recess for cam cap and an outer surface of the end cam cap. The inner surface includes the side surfaces of the recess for cam cap and the outer surface includes the side surfaces of the end cam cap.

4 Claims, 10 Drawing Sheets

INTERNAL COMBUSTION ENGINE

CROSS-REFERENCE TO RELATED APPLICATION

The present application claims priority to Japanese Patent Application No. 2016-116854 filed on Jun. 13, 2016, which is incorporated herein by reference in its entirety.

BACKGROUND OF THE INVENTION

1. Field of the Invention

The present invention relates to an internal combustion engine that has a dual lubricating oil circulation passage.

2. Description of the Related Art

There is known an internal combustion engine having a dual lubricating oil circulation passage.

Such an internal combustion engine includes a cylinder block, a cylinder head, a cylinder head cover, an oil pan and a chain cover.

A cylinder bore is formed inside the cylinder block. A pistons is slidably provided in the cylinder bore.

The oil pan is connected to the bottom portion of the cylinder block. The lower space of the cylinder block and a crank shaft storage space, which is the interior space of the oil pan, are communicated with the cylinder bore. In addition, the crank shaft storage space stores a crank shaft that rotates in conjunction with the operation of the piston.

The cylinder head is connected to the upper portion of the cylinder block. The space defined by a recess formed in the bottom portion of the cylinder head, the cylinder bore, and the upper end surface of the piston constitutes a combustion chamber. An intake valve and an exhaust valve, both of which can move upward and downward, are provided inside the cylinder head. Additionally, an inlet port and an exhaust port, which communicate with the recess (the combustion chamber) and are opened and closed by the intake valve and the exhaust valve respectively, are formed in the cylinder head.

A camshaft storage space is formed inside the cylinder head. The camshaft storage space, whose top surface is opened, is independent from the recess (the combustion chamber), the inlet port and the exhaust port. In other words, the camshaft storage space does not communicate with the recess, the inlet port and the exhaust port.

A camshaft, which extends linearly and is rotatable about its own axis, is disposed in the camshaft storage space. A through-hole is formed through a chain cover adjacent wall that constitutes a part of the outer peripheral wall of the cylinder head. One end of the camshaft passes through this through-hole and protrudes out of the cylinder head. An oil seal is provided between the inner peripheral surface of the through-hole and the outer peripheral surface of the camshaft. This oil seal is in contact with the inner peripheral surface of the through-hole and the outer peripheral surface of the camshaft in an air-tight and water-tight manner.

As is well known, both the intake valve and the exhaust valve are interlocked with the camshaft. Namely, when the camshaft rotates, the intake valve and the exhaust valve operate to open and close the inlet port and the exhaust port, respectively.

The cylinder head cover is fixed to the top surface of the cylinder head. Namely, the top surface of the cylinder head is covered with the cylinder head cover.

The chain cover is fixed to the cylinder block, the cylinder head, and the oil pan.

A chain storage space is formed inside the chain cover. This chain storage space communicates with the crank shaft storage space of the oil pan. On the other hand, the chain storage space does not communicate with the camshaft storage space. Namely, the chain cover adjacent wall of the cylinder head separates the camshaft storage space from the chain storage space in an in-air-tight and water-tight manner.

The one end of the camshaft, which passes through the through-hole of the chain cover adjacent wall, is located in the chain storage space. A timing chain, which is arranged in both the chain storage space and the interior space of the oil pan, is wounded around a sprocket provided at one end of the camshaft and a sprocket provided at one end of the crank shaft. Namely, the crank shaft and the camshaft are interlocked by the timing chain so that the camshaft is rotated by the rotational force of the crank shaft.

The crank shaft storage space of the oil pan is filled with a first lubricating oil.

In addition, the crank shaft storage space is equipped with a first oil pump to circulate the first lubricating oil through the crank shaft storage space, the interior space of the cylinder block, and the chain storage space. Namely, a first lubricating oil circulation passage is formed so as to pass through the crank shaft storage space, the interior space of the cylinder block, and the chain storage space.

On the other hand, a sub oil pan, which communicates with the camshaft storage space, is formed in the cylinder head. The sub oil pan is filled with a second lubricating oil.

In addition, the camshaft storage space is equipped with a second oil pump to circulate the second lubricating oil through the sub oil pan and the camshaft storage space. Namely, a second lubricating oil circulation passage is formed so as pass through the sub oil pan and the camshaft storage space.

Then, when the first oil pump is operated, the first lubricating oil circulates through the first lubricating oil circulation passage, and when the second oil pump is operated, the second lubricating oil circulates through the second lubricating oil circulation passage.

The first lubricating oil circulating through the first lubricating oil circulation passage enables the piston, the crank shaft, and the timing chain to operate smoothly. Furthermore, the second lubricating oil circulating through the second lubricating oil circulation passage enables the camshaft, the intake valve, and the exhaust valve to operate smoothly.

As described above, the camshaft storage space is independent from the recess (the combustion chamber) of the cylinder head, the inlet port, and the exhaust port. Additionally, the chain cover adjacent wall of the cylinder head separates the camshaft storage space from the chain storage space in an air-tight and water-tight manner.

Therefore, the first lubricating oil circulation passage and the second lubricating oil circulation passage are independent from each other. In other words, the first lubricating oil does not flow into the second lubricating oil circulation passage and the second lubricating oil does not flow into the first lubricating oil circulation passage.

By the way, when the internal combustion engine operates, so-called blowby gas is generated in the combustion chamber. This blowby gas flows through the gap between the inner circumferential surface of the cylinder bore and the end gap of the piston ring attached to the piston, and flows into the crank shaft storage space. The blowby gas comes in contact with the first lubricating oil, and then the first lubricating oil deteriorates. Then, the first lubricating oil needs to be replaced with new lubricating oil with a certain frequency.

On the other hand, the recess (the combustion chamber) and the camshaft storage space are independent from each other. Then, the blowby gas does not flow into the camshaft storage space to come into contact with the second lubricating oil.

Additionally, since the chain cover adjacent wall separates the camshaft storage space from the chain storage space in an air-tight and water-tight manner, the blowby gas does not flow into the camshaft storage space from the chain storage space to come into contact with the second lubricating oil.

Therefore, the second lubricating oil is harder to deteriorate than the first lubricating oil. Then, the exchange frequency of the second lubricating oil with new lubricating oil is lower than that of the first lubricating oil.

It should be noted that Japanese Unexamined Patent Application Publication No. H08-246831 and Japanese Unexamined Patent Application Publication No. 2011-190721 disclose a background technology related to the present invention.

SUMMARY OF THE INVENTION

Typically, a plurality of portions of the lower half portion of the camshaft, which are separated from each other in the axial direction of the camshaft, are rotatably supported by a plurality of journal bearings, which are disposed inside the cylinder head along the axial direction thereof, respectively.

Furthermore, a plurality of cam caps, which are disposed in the camshaft storage space, are mounted on a plurality of portions of the upper half portion of the camshaft, which are separated from each other in the axial direction, from above, respectively. Each of the cam caps rotatably supports the upper half portion of the camshaft. In addition, each of the cam caps is fixed to corresponding one of journal bearings.

The cam cap positioned on the most chain cover adjacent wall side is disposed in the camshaft storage space so as to be close to the inner surface (the side surface that defines the camshaft storage space) of the chain cover adjacent wall.

Incidentally, the axial direction dimension of the camshaft storage space (i.e., the cylinder head) is the dimension including the thickness of the chain cover adjacent wall and the thickness of all the cam caps.

Then, the internal combustion engine having the above structure, in which the chain cover adjacent wall and all the cam caps are arranged in the axial direction, has difficulty in reducing both the axial direction dimension of the cylinder head and the axial direction dimension of the entire internal combustion engine.

The present invention has been made to cope with the above problems, and has an object to provide an internal combustion engine that can securely prevent the first lubricating oil circulation passage and the second lubricating oil circulation passage from communicating with each other between the camshaft storage space and the chain storage space, and can reduce the dimension of the entire internal combustion engine in the axial direction of the camshaft.

In order to achieve the object, an internal combustion engine comprises:

a cylinder block (20) including a cylinder bore (21) which supports a piston (23) so as to be slidable;

an oil pan (30) provided therein with a crank shaft storage space (32) for storing a crank shaft (25) rotating in conjunction with an operation of the piston, the oil pan connected to the cylinder block;

a cylinder head (35) provided therein with a port (42, 43), which is communicated with the cylinder bore and made to be opened and closed by a valve (44, 45) reciprocating in conjunction with the operation of the piston, a sub oil pan (40*a*), and a camshaft storage space (47*a*), which has no communication with an interior of the oil pan, the crank shaft storage space, and the cylinder bore;

a camshaft (65, 70) disposed in the camshaft storage space, the camshaft including a plurality of supported portions (66, 71) whose lower portions are rotatably supported by the cylinder head so that the camshaft rotates about its own axis to reciprocate the valve, the supported portions arranged at an interval in an axial direction of the camshaft;

a plurality of cam caps (75, 80), fixed to the cylinder head, for rotatably supporting upper portions of the supported portions of the camshaft;

a cover member (88) connected to the oil pan and the cylinder head so that the cover member is provided therein with an interlocking member storage space (89), the interlocking member storage space storing an annular interlocking member (86) interlocking the crank shaft and the camshaft, the interlocking member storage space having communication with the crank shaft storage space and having no communication with the camshaft storage space;

a first lubricating oil (91) filled in the oil pan so as to circulate through the interior of the oil pan, the crank shaft storage space, the cylinder bore and the interlocking member storage space;

a second lubricating oil (101) filled in the sub oil pan so as to circulate through the an interior of the sub oil pan and the camshaft storage space; and a cover adjacent wall (48) for forming part of the cylinder head and for separating the interlocking member storage space from the camshaft storage space.

Atmosphere pressure of the interlocking member storage space is kept lower than atmosphere pressure of the camshaft storage space.

A recess for cam cap (51) is formed on an upper end surface of the cover adjacent wall so as to penetrate through the cover adjacent wall in the axial direction of the camshaft.

One of the plurality of the cam caps, which is disposed in the recess for cam cap and is located closest to the cover member among the cam caps, is an end cam cap (80).

The end cam cap is provided with a pair of side surfaces which are spaced from each other in a direction orthogonal to the axial direction.

The side surfaces of the end cam cap and a pair of side surfaces (51*b*) of the recess for cam cap form two cross-sectional area gradually changing gaps (S) therebetween. Each of the cross-sectional area gradually changing gaps has both open ends which are separated from each other in the axial direction and each of the cross-sectional area gradually changing gaps has a cross-sectional area which gradually decreases as approaching to the interlocking member storage space from an intermediate portion thereof in the axial direction or a portion thereof farther from the interlocking member storage space than the intermediate portion in the axial direction.

A gasket (G) is filled between an inner surface of the recess for cam cap and an outer surface of the end cam cap. The inner surface includes the side surfaces of the recess for cam cap and the outer surface includes the side surfaces of the end cam cap.

In the internal combustion engine of the present invention, the end cam cap is disposed in the recess for cam cap formed on the upper end surface of the cover adjacent wall of the cylinder head. Namely, the cover adjacent wall and the end cam cap are disposed at the same position in the axial direction of the camshaft.

Therefore, compared with a conventional internal combustion engine, the present invention can reduce both the dimension of the cylinder head and the dimension of the entire internal combustion engine in the axial direction of the camshaft.

Furthermore, since an atmosphere pressure of the interlocking member storage space is lower than an atmosphere pressure of the camshaft storage space, the second lubricating oil in the camshaft storage space always attempt to flow into the interlocking member storage space via a gap between the recess for cam cap and the end cam cap.

However, a semi-solidified gasket is filled in the gap between the outer surface of the cam cap and the inner surface of the recess for cam cap.

Therefore, the second lubricating oil does not leak to the interlocking member storage space via the gap between the recess for cam cap and the end cam cap, and thus does not mix with the first lubricating oil.

Therefore, the second lubricating oil does not decrease.

Furthermore, gaps need to be formed between both side surfaces of the end cam cap and both side surfaces of the recess for cam cap in order to dispose the end cam cap in the recess for cam cap. In other words, the dimension between the both side surfaces of the end cam cap needs to be smaller than the dimension between the both side surfaces of the recess for cam cap.

In the present invention, the cross-sectional area gradually changing gaps, each of which has both open ends separated from each other in the axial direction and has a cross-sectional area gradually decreasing as approaching to the interlocking member storage space from the intermediate portion thereof in the axial direction or the portion thereof farther from the interlocking member storage space than the intermediate portion in the axial direction, are formed between both side surfaces of the end cam cap and both side surfaces of the recess for cam cap.

Since the atmosphere pressure of the interlocking member storage space is lower than the atmosphere pressure of the camshaft storage space, a pressure is applied from the camshaft storage space to the gasket that is semi-solidified in this cross-sectional area gradually changing gap.

However, the cross-sectional area of the interlocking member storage space side end of the cross-sectional area gradually changing gap is smaller than the cross-sectional area of the intermediate portion of the cross-sectional area gradually changing gap. Then, the interlocking member storage space side end of the cross-sectional area gradually changing gap generates a large resistance force to prevent the gasket from moving to the interlocking member storage space.

Therefore, the gasket hardly discharged to the interlocking member storage space via the cross-sectional area gradually changing gap.

Therefore, a chance that the second lubricating oil filled in the camshaft storage space of the cylinder head leaks to the interlocking member storage space via the cross-sectional area gradually changing gap is much smaller compared with the case where the side surfaces of the recess for cam cap and the side surfaces of the end cam cap are flat surfaces parallel to each other.

An interlocking member storage space side end of each of the cross-sectional area gradually changing gaps may be located closer to the camshaft storage space than an interlocking member storage space side surface of the cover adjacent wall.

The side surfaces of the end cam cap and the side surfaces of the recess for cam cap may be flat surfaces.

Each of the side surfaces of the end cam cap and each of the side surfaces of the recess for cam cap may face each other so as to form a minute gap therebetween and be parallel to each other at a position between each of the cross-sectional area gradually changing gaps and the interlocking member storage space.

This "parallel" includes not only "complete parallel" but also "substantially parallel".

Between the interlocking member storage space side end of the cross-sectional area gradually changing gap and the interlocking member storage space side surface of the cover adjacent wall, the side flat surfaces of the end cam cap and the side flat surfaces of the recess for cam cap surface face with each other so as to form the minute gaps therebetween and be parallel to each other.

Therefore, a chance that the gasket is discharged to the interlocking member storage space via the cross-sectional area gradually changing gap become much smaller compared with the case where the interlocking member storage space side end of the cross-sectional area gradually changing gap is positioned at the same position as the interlocking member storage space side surface of the cover adjacent wall. Namely, the chance that the second lubricating oil leaks to the interlocking member storage space via the cross-sectional area gradually changing gap becomes much smaller.

A bottom surface (51*a*) of the recess for cam cap and a bottom surface of the end cam cap may be horizontal flat surfaces.

If the cross-sectional area gradually changing gap is formed between the bottom surface of the end cam cap and the bottom surface of the recess for cam cap and the gasket is filled in this cross-sectional area gradually changing gap, the bottom surface of the recess for cam cap supports the end cam cap unstably.

However, when the present invention is configured in this way, the supporting state of the end cam cap by the bottom surface of the recess for cam cap can become stable.

A cutout may be formed on each of the side surfaces of the end cam cap.

Each of the cutouts and each of the side surfaces of the recess for cam cap may form the cross-sectional area gradually changing gap therebetween when the end cam cap is disposed in the recess for cam cap.

The cutout for forming the cross-sectional area gradually changing gap between the side surfaces of the end cam cap and the side surfaces of the recess for cam cap can be easily formed on the side surfaces of the end cam cap than the side surfaces of the recess for cam cap.

Therefore, when the present invention is configured in this way, the productivity of the internal combustion engine can be increased.

In the above description, references used in the following descriptions regarding embodiments are added with parentheses to the elements of the present invention, in order to understand the invention. However, those references should not be used to limit the scope of the present invention.

Other objects, other features, and accompanying advantages of the present invention are easily understood from the description of embodiments of the present invention to be given referring to the following drawings.

DETAILED DESCRIPTION OF THE PREFERRED EMBODIMENTS

An internal combustion engine of the present invention will be described hereinafter with reference to the accompanying figures.

Figure 1:
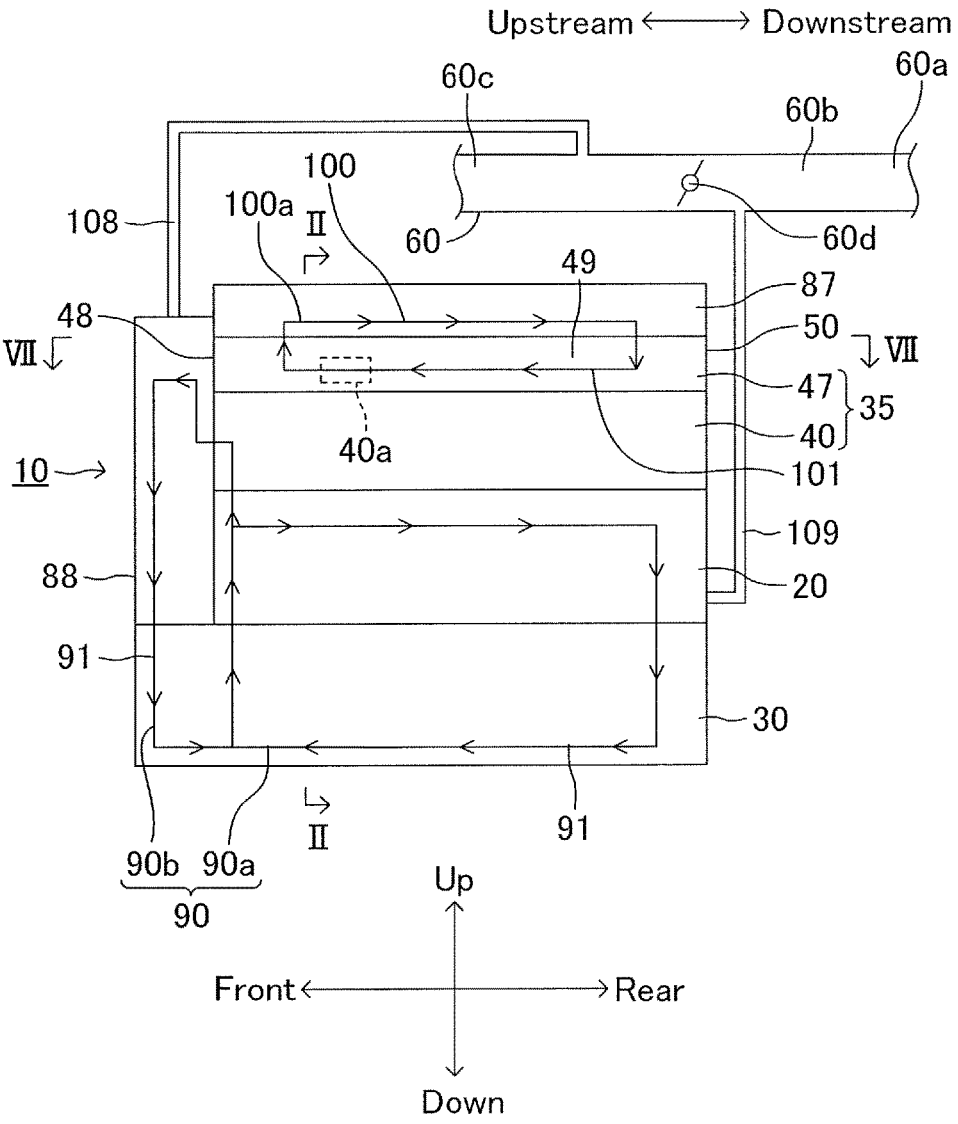
FIG. 1 is a schematic overall view of an internal combustion engine according to an embodiment of the present invention.
Figure 2:
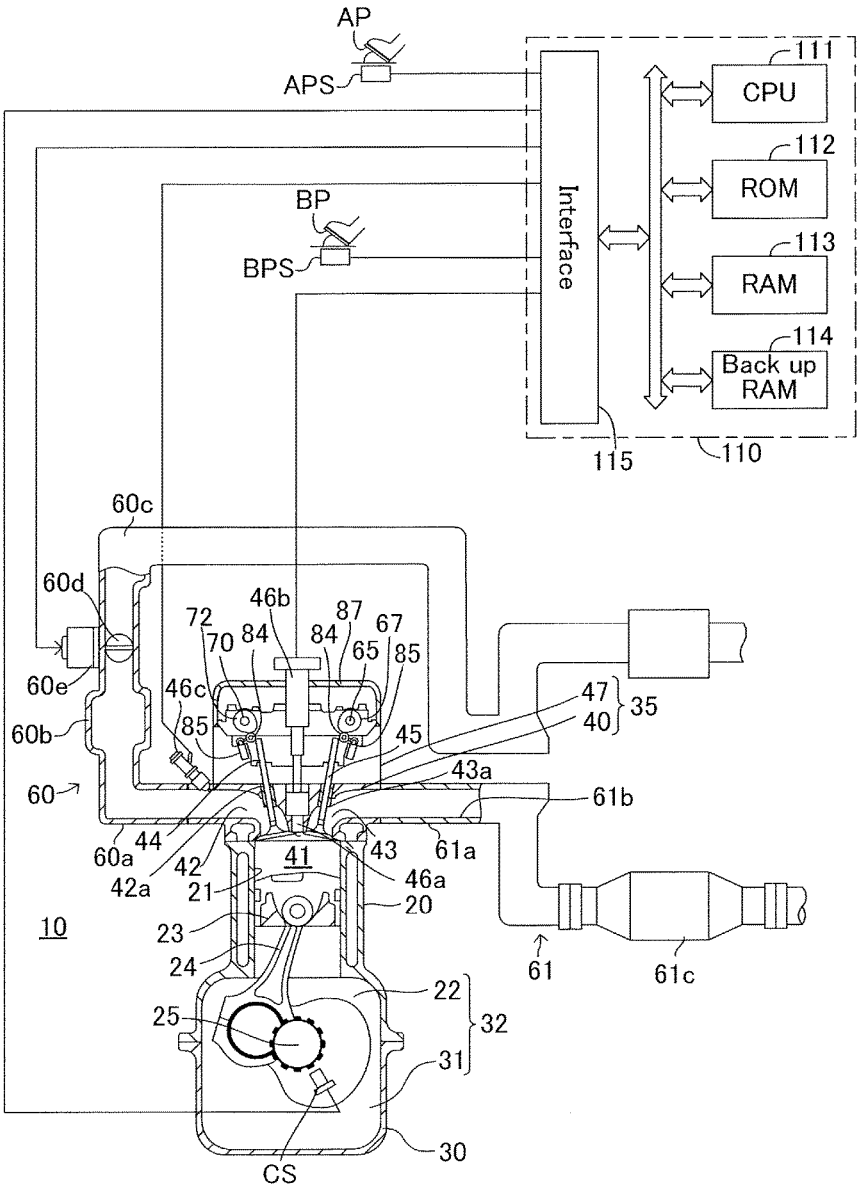
FIG. 2 is a cross-sectional view of the internal combustion engine taken along the line II-II in FIG. 1 and a schematic view of an electronic control unit.

FIGS. 1 and 2 show a schematic configuration of a multi-cylinder (for example, a four-cylinder) internal combustion engine 10. Note that, FIG. 2 shows a cross section of a cylinder. However, the other cylinders have the same configurations as this cylinder. This internal combustion engine 10 is installed in a vehicle, which is not shown, as a driving source of the vehicle.

This internal combustion engine 10 is provided with a cylinder block 20, an oil pan 30, a cylinder head body 40, a camshaft housing 47, an intake system 60, an exhaust system 61, an exhaust camshaft 65, an intake camshaft 70, a cam cap 75, an end cam cap 80, a timing chain 86, a cylinder head cover 87, a cover member 88, a first lubricating oil circulation system 90, a second lubricating oil circulation system 100, a fresh air inlet pipe 108, and a blowby gas circulation pipe 109, as main components.

As shown in FIG. 2, a cylinder bore 21 is formed in an upper side portion of the cylinder block 20. A lower space 22 communicating with the cylinder bore 21 is formed in the lower side portion of the cylinder block 20. A piston 23 is provided in the cylinder bore 21 so as to be able to slide in the axial direction of the cylinder bore 21.

The upper portion of the connecting rod 24 is rotatably connected to the piston 23.

The upper surface of the oil pan 30 is in contact with the lower surface of the cylinder block 20 in an air-tight and water-tight manner. The cylinder block 20 and the oil pan 30 are fixed with each other by using a bolt and a nut. As shown in FIG. 1, the forward and rearward direction length of the oil pan 30 is longer than that of the cylinder block 20. The front end portion of the oil pan 30 is positioned at a more forward position than the front end portion of the cylinder block 20.

A crankshaft bearing (not shown) provided at the bottom of the cylinder block 20 rotatably supports a crank shaft 25 extending in the forward and rearward direction. Furthermore, the lower end portion of the connecting rod 24 is rotatably connected to the connecting rod bearing (not shown) formed in the crank shaft 25. A sprocket (not shown) is fixed to the front portion of the crank shaft 25.

The interior space of the oil pan 30 constitutes a first lubricating oil storage room 31. Furthermore, the lower space 22 of the cylinder block 20 and the first lubricating oil storage room 31 of the oil pan 30 constitute a crank shaft storage space 32 communicating with the cylinder bore 21.

A cylinder head 35 is fixed to the upper end portion of the cylinder block 20. The cylinder head 35 is provided with the cylinder head body 40 and the camshaft housing 47.

Figure 3:
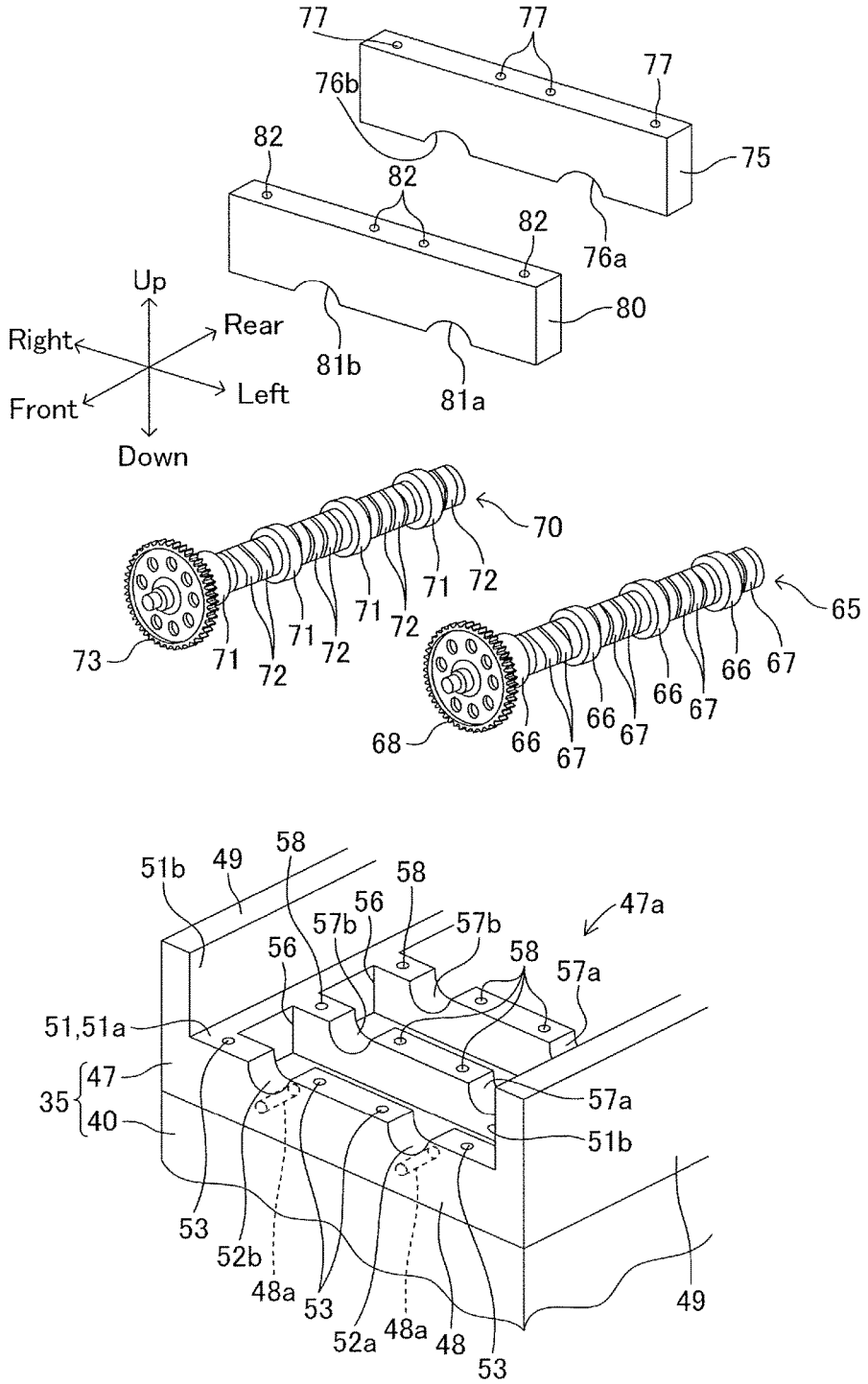
FIG. 3 is an exploded perspective view of a cylinder head body, a camshaft housing, an exhaust camshaft, an intake camshaft and cam caps.
Figure 4:
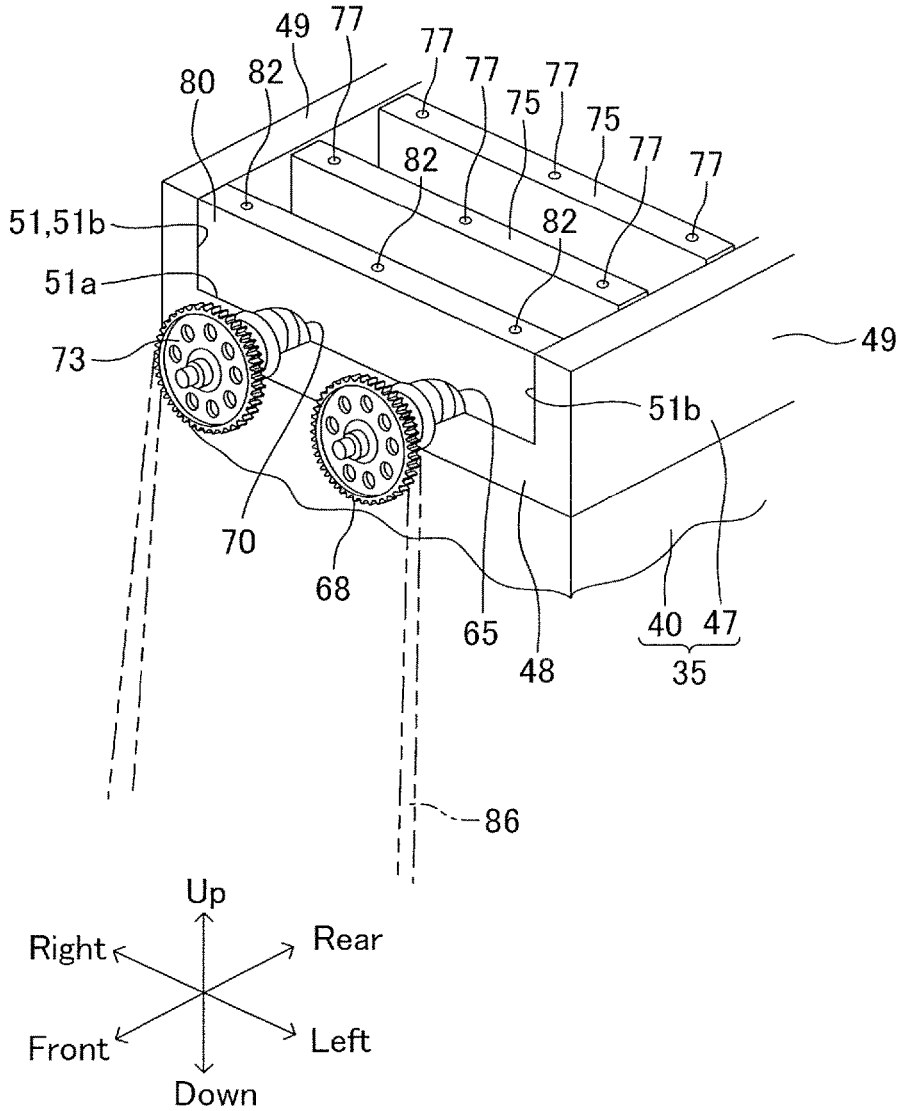
FIG. 4 is a perspective view of the cylinder head body, the camshaft housing, the exhaust camshaft, the intake camshaft and the cam caps which are assembled.

The lower end surface of the cylinder head body 40 is in contact with the upper end surface of the cylinder block 20 in an air-tight and water-tight manner. The cylinder head body 40 and the cylinder block 20 are fixed to each other by using a bolt. As shown in FIGS. 3 and 4, the sectional shape of the cylinder head body 40, which is formed by cutting the cylinder head body 40 along a horizontal plane, has a subsequently rectangular shape which is long in the forward and rearward direction. The upper end surface of the cylinder head body 40 is a flat surface.

As shown in FIG. 2, a recess formed at the bottom of the cylinder head body 40, the cylinder bore 21, and the upper end surface of the piston 23 define (form) the combustion chamber 41.

Furthermore, an inlet port 42 and an exhaust port 43, both of which communicate with the combustion chamber 41, are formed in the cylinder head body 40. In addition, an intake valve guide 42*a* and an exhaust valve guide 43*a*, both of which have cylindrical shapes, are fixed to the cylinder head body 40. The lower end of the intake valve guide 42*a* is connected to the inlet port 42, and the lower end of the exhaust valve guide 43*a* is connected to the exhaust port 43. Further, cylindrical seal members (not shown) are fixed to the upper portion of each intake valve guide 42*a* and the upper portion of each exhaust valve guide 43*a*, respectively. An intake valve 44 and an exhaust valve 45 are inserted into each intake valve guide 42*a* and each exhaust valve guide 43*a*, respectively. The intake valve 44 and the exhaust valve 45 are movable in the axial direction of the intake valve guide 42*a* and the axial direction of the exhaust valve guide 43*a*, respectively. A stem portion of each of the intake valves 44 is slidably supported by each intake valve guide 42*a* and a stem portion of each of the exhaust valves 45 is slidably supported by each exhaust valve guide 43*a*. As is well known, each of the intake valves 44 and each of the exhaust valves 45 open and close the corresponding inlet port 42 and the corresponding exhaust port 43 respectively by reciprocating in the axial direction of the intake valve guide 42*a* and the axial direction of the exhaust valve guide 43*a*, respectively.

An ignition plug 46*a*, an igniter 46*b* that generates a high voltage given to the ignition plug 46*a*, and an injector 46*c* that injects the fuel into the inlet port 42 are provided inside the cylinder head body 40.

The camshaft housing 47 is provided on the upper end surface of the cylinder head body 40.

As shown in FIGS. 3 and 4, the camshaft housing 47 is a frame body having a substantially rectangular shape in a plane view. Both upper and lower surfaces of the camshaft housing 47 are opened. The upper and lower surfaces of the camshaft housing 47 are flat surfaces. The upper end surface of the cylinder head body 40 and the lower end surface of the camshaft housing 47 are in contact with each other in an air-tight and water-tight manner. Furthermore, the cylinder head body 40 and the camshaft housing 47 are fixed to each other by a bolt.

The camshaft housing 47 includes a chain cover adjacent wall 48, a pair of the side walls 49, and a rear wall 50 (see FIG. 1). The chain cover adjacent wall 48 constitutes the front surface of the camshaft housing 47. The pair of the side walls 49 constitute the left and right side surfaces of the camshaft housing 47, respectively. The rear wall 50 constitutes the rear surface of the camshaft housing 47.

A camshaft storage space 47*a*, whose top is opened, is formed inside the camshaft housing 47.

The camshaft storage space 47*a* is independent from the recess (the combustion chamber 41) formed at the bottom of the cylinder head body 40. In other words, the camshaft storage space 47*a* and this combustion chamber 41 do not communicate with each other. Since each seal member is fixed to the upper portion of each of the intake valve guides 42*a* and the upper portion of each of the exhaust valve guides 43*a* respectively, the camshaft storage space 47*a* is independent from each of the inlet ports 42 and each of the exhaust ports 43. Namely, the camshaft storage space 47*a* dose not communicate with the inlet ports 42 and the exhaust ports 43.

As shown in FIGS. 3 and 4, a recess for cam cap 51 having a rectangular shape in a front view is formed at the upper end portion of the chain cover adjacent wall 48. The recess for cam cap 51 penetrates through the chain cover adjacent wall 48 in the forward and rearward direction.

The bottom surface 51*a* of the recess for cam cap 51 is a horizontal flat surface. The left and right side surfaces 51*b* of the recess for cam cap 51 are flat surfaces that are parallel to each other and are orthogonal to the lateral direction (left and right direction).

A pair of left and right bearing recesses 52*a*, 52*b* are formed on the bottom surface 51*a*. The cross-sectional shape of the left bearing recess 52*a* and the cross-sectional shape of the right bearing recess 52*b* are semicircular shapes, which are the same as each other, respectively. Four female screw holes 53 are formed on the bottom surface 51*a* of the recess for cam cap 51 so as to separate from the bearing recesses 52*a*, 52*b*.

Furthermore, the camshaft housing 47 is provided integrally with a plurality of journal bearings 56 that are arranged at approximately equal intervals in the forward and rearward direction. The upper end surface of each journal bearing 56 is a flat surface located on a plane on which the bottom surface 51*a* of the recess for cam cap 51 is located.

A pair of left and right bearing recesses 57*a*, 57*b*, each of which has a semicircular shaped cross-section, are formed on the upper surface of each of the journal bearings 56. Furthermore, each of the bearing recesses 57*a* is coaxial with the bearing recess 52*a*, and each of the bearing recesses 57*b* is coaxial with the bearing recess 52*b*. Four female screw holes 58 are formed on the upper end surface of each of the journal bearings 56 so as to separate from the bearing recesses 57*a*, 57*b*.

As shown in FIG. 2, one end of the intake system 60 and one end of the exhaust system 61 are respectively connected to the upstream end of each of the inlet ports 42 and the downstream end of each of the exhaust ports 43 of the cylinder head body 40. The intake system 60 supplies air-fuel mixture including fuel (e.g., gasoline) and air to the cylinder block 20. The exhaust system 61 emits exhaust gas from the cylinder block 20 to the outside of the internal combustion engine 10.

The intake system 60 is provided with an intake manifold 60*a* connected to the upstream end of each inlet port 42, a surge tank 60*b* connected to the intake manifold 60*a*, a throttle body connected to the surge tank 60*b*, and an intake duct 60*c* connected to the throttle body. The throttle body is provided integrally with a throttle valve 60*d* and an actuator for throttle valve 60*e*.

The exhaust system 61 comprises an exhaust pipe 61*b*, which includes an exhaust manifold 61*a* communicating with the downstream end of each exhaust port 43, and a catalyst apparatus 61*c*, which is arranged in the exhaust pipe 61*b*.

As shown in FIGS. 3 and 4, a plurality of portions of the lower half portion of the exhaust camshaft 65 are rotatably supported by the bearing recesses 52*a* and the bearing recesses 57*a* of the camshaft housing 47. Likewise, a plurality of portions of the lower half portion of the intake camshaft 70 are rotatably supported by the bearing recesses 52*b* and the bearing recesses 57*b*.

The exhaust camshaft 65 and the intake camshaft 70 are elongated members whose axes extend in the forward and rearward direction. The exhaust camshaft 65 and the intake camshaft 70 have the supported portions 66 and the supported portions 71, respectively. The number of the supported portions 66 and the number of the supported portions 71 are the same as the total number of the chain cover adjacent wall 48 and all the journal bearings 56. Each of the outer peripheral surfaces of the supported portions 66, 71 is a cylindrical surface that has the same curvature as that of corresponding one of the bearing recesses 52*a*, 52*b*, 57*a*, 57*b*, respectively. Furthermore, the exhaust camshaft 65 has multiple pairs of the cams 67 formed at different positions from the supported portions 66. Likewise, the intake camshaft 70 has multiple pairs of the cams 72 formed at different positions from the supported portions 71. Furthermore, sprockets 68, 73 are fixed to the vicinity of the front end of the exhaust camshaft 65 and the vicinity of the front end of the intake camshaft 70, respectively.

The lower half portion of the foremost supported portion 66 of the exhaust camshaft 65 and the lower half portion of the foremost supported portion 71 of the intake camshaft 70 are supported by the bearing recess 52*a* and the bearing recess 52*b* of the camshaft housing 47, respectively. On the other hand, the lower half portions of the remaining supported portions 66 of the exhaust camshaft 65 are rotatably supported by each of the bearing recesses 57*a* of the journal bearings 56, respectively, and the lower half portions of the remaining supported portions 71 of the intake camshaft 70 are rotatably supported by each of the bearing recesses 57*b* of the journal bearings 56, respectively. Furthermore, the sprocket 68 of the exhaust camshaft 65 and the sprocket 73 of the intake camshaft 70 are located at a more forward position than the chain cover adjacent wall 48 of the camshaft housing 47.

Figure 7:
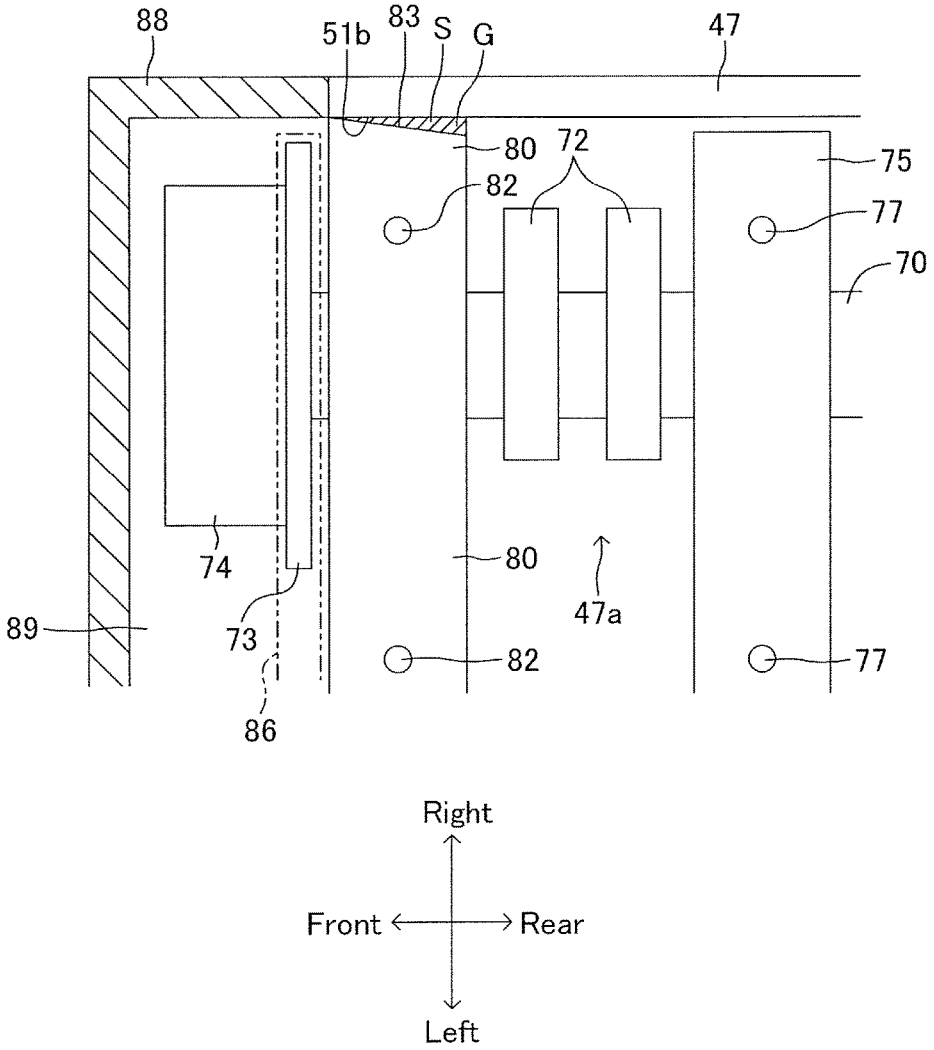
FIG. 7 is a cross-sectional view taken along line VII-VII of FIG. 1.

Further, a VVT 74 (variable valve timing mechanism) is provided at the front end portion of each of the exhaust camshaft 65 and the intake camshaft 70, respectively (see FIG. 7. The VVT 74 of the exhaust camshaft 65 is not shown). Each of these VVTs 74 is operated by a driving force of an actuator for VVT.

The cam caps 75 are mounted on the upper end surface of each of the journal bearings 56 of the camshaft housing 47 from above, respectively.

Each of the cam caps 75 is a plate material that has a substantially rectangular shape in the front view, and its lateral dimension (a dimension in the left and right direction) is shorter than the lateral dimension between the inner surfaces of the left and right side walls 49 of the camshaft housing 47. Further, a pair of left and right bearing recesses 76*a*, 76*b* are formed on the bottom surface of each of the cam caps 75. The cross-sectional shapes of the bearing recesses 76*a*, 76*b* are semicircular shapes that are vertically symmetrical with the bearing recesses 57*a*, 57*b*. In addition, four through-holes 77 are formed in each of the cam caps 75 so as to be at positions different from those of the bearing recesses 57*a*, 57*b*. Each of the through-holes 77 penetrates through the cam caps 75 in the vertical direction.

The lower surface of each of the cam caps 75 are in contact with the corresponding one of upper surfaces of the journal bearings 56. Furthermore, each of the cam caps 75 is fixed to corresponding one of the journal bearings 56 by screwing the lower end of each of bolts (not shown), which are inserted into through-holes 77 of each journal bearing 56 from above, into corresponding one of the female screw holes 58.

The bearing recess 76*a* of each cam cap 75 rotatably supports the upper half portion of corresponding one of the supported portions 66 of the exhaust camshaft 65, respectively. Likewise, the bearing recess 76*b* of each cam cap 75 rotatably supports the upper half portion of corresponding one of the supported portions 71 of the intake camshaft 70, respectively.

The end cam cap 80 is detachably mounted to the recess for cam cap 51 of the camshaft housing 47.

The dimension in the forward and rearward direction of the end cam cap 80 is the same as that of the recess for cam cap 51. The vertical dimension of the end cam cap 80 is the same as that of the recess for cam cap 51. However, the dimension in the forward and rearward direction of the end cam cap 80 does not have to be the same as that of the recess for cam cap 51 as long as the vertical dimensions of the left and right ends of the end cam cap 80 are the same as that of the recess for cam cap 51. On the other hand, the lateral dimension of the end cam cap 80 is slightly smaller than that of the recess for cam cap 51.

The six surfaces that form the entire outer surface of the end cam cap 80 are flat surfaces. Furthermore, the upper surface and the lower surface of the end cam cap 80 are horizontal flat planes. However, the entire outer surface excluding the lower surface of the end cam cap 80 does not have to be a flat surface (flat surfaces) while the lower surface of the end cam cap 80 must be a flat surface.

A pair of left and right bearing recesses 81*a*, 81*b* are formed on the bottom surface of the end cam cap 80. The cross-sectional shapes of the bearing recesses 81*a*, 81*b* are semicircular shapes that are vertically symmetrical with the bearing recesses 52*a*, 52*b*, respectively. Four through-holes 82 are formed in the end cam cap 80 so as to be at positions different from those of the bearing recesses 81*a*, 81*b*. Each of the through-holes 82 penetrates through the end cam cap 80 in the vertical direction.

The end cam cap 80 has a pair of left and right side surfaces that are spaced apart from each other in a direction orthogonal to the axial directions of the exhaust camshaft 65 and the intake camshaft 70. As shown in FIG. 7, the right side surface of the end cam cap 80 is constituted by a gap forming surface 83 that is a flat surface in the plane view. The gap forming surface 83 gradually approaches the center portion of the end cam cap 80 as approaching from the front thereof to the rear thereof in the plane view. This gap forming surface 83 is inclined with respect to the forward and rearward direction in the plane view. In other words, the right side portion of the end cam cap 80 is cut out (notched) so as to form the gap forming surface 83.

Likewise, although not shown, the left side portion of the end cam cap 80 is constituted by a gap forming surface 83 that is bilaterally symmetrical with this right side gap forming surface 83. In other words, the left side portion of the end cam cap 80 is cut out (notched) so as to form this gap forming surface 83.

Pasty gasket G, which is called FIPG (Formed In Place Gasket) and is an oil resistant sealing material, is applied to the entire bottom surface of the end cam cap 80, the entire left gap forming surface 83 of the end cam cap 80, and the entire right gap forming surface 83 of the end cam cap 80. Specific example of this gasket G is a gasket that includes a room temperature vulcanizing silicone rubber which is paste and contains a base silicone oil, a cross-linking agent, a filler, and an adhesion imparting agent. This gasket G is pasty when it is placed in a tube (container) not shown (namely, when it is not in contact with the air). Further, the gasket G is turned into semi-solidified with the lapse of time when it comes into contact with the air. The end cam cap 80 to which the gasket G is applied is fitted into the recess for cam cap 51. Since the lateral dimension of the end cam cap 80 is slightly smaller than that of the recess for cam cap 51, the end cam cap 80 can be smoothly fitted into the recess for cam cap 51.

Furthermore, bolts (not shown) are inserted into each of the through-holes 82 of the end cam cap 80 from above, and the lower end of each of bolts is screwed into each of the female screw holes 53 formed in the recess for cam cap 51.

The end cam cap 80 is thus fixed to the recess for cam cap 51. As a result, the upper surface (at least the upper surfaces of the left and right end portions) of the end cam cap 80 is located on a flat (plane) on which the upper surface of the camshaft housing 47 is located.

When the end cam cap 80 is fixed to the recess for cam cap 51, the bearing recess 81*a* and the bearing recess 52*a* rotatably support the foremost supported portion 66 of the exhaust camshaft 65. Likewise, the bearing recess 81*b* and the bearing recess 52*b* rotatably support the foremost supported portion 71 of the intake camshaft 70. Then, the exhaust camshaft 65 and the intake camshaft 70 are allowed to rotate relative to the camshaft housing 47 about their own axes.

Further, as shown in FIG. 7, when the end cam cap 80 is fixed to the recess for cam cap 51, cross-sectional area gradually changing gaps S, which are triangle-shapes in the plane view, are formed between the left and right gap forming surfaces 83 of the end cam cap 80 and the left and right side surfaces 51*b* of the recess for cam cap 51, respectively. Both the front end and the rear end of each of the left and right cross-sectional area gradually changing gaps S are opened. Furthermore, the cross-sectional area of each of the cross-sectional area gradually changing gaps S, which is formed by cutting each of the cross-sectional area gradually changing gaps S with a plane orthogonal to the forward and rearward direction, is gradually reduced as approaching from the rear thereof to the front thereof.

At the moment when the gasket G is applied to the end cam cap 80, the gasket G is pasty. However, the gasket G is turned into semi-solidified gradually with the lapse of time. When a certain period of time elapses after the end cam cap 80 is fitted into the recess for cam cap 51, the left and right gap forming surfaces 83 and the bottom surface of the end cam cap 80 and the inner surface of the recess for cam cap 51 are fixed to each other by the semi-solidified gasket G.

The space between both side surfaces and the bottom surface of the end cam cap 80 and the inner surface of the recess for cam cap 51 is filled with the semi-solidified gasket G. Namely, the semi-solidified the gasket G comes into contact with the left and right gap forming surfaces 83, the bottom surface of the end cam cap 80, and the inner surface of the recess for cam cap 51 in an air-tight and water-tight manner. Furthermore, a portion of the gasket G, which is semi-solidified between the bottom surface of the end cam cap 80 and the bottom surface 51*a* of the recess for cam cap 51, and another portions of the gasket G, which are semi-solidified between the left and right gap forming surfaces 83 of the end cam cap 80 and the left and right surfaces 51*b* of the recess for cam cap 51, are continuous with each other.

As shown in FIG. 2, a plurality of rocker arms 84 are provided inside the camshaft housing 47 so as to be swingable. Half the number of the rocker arms 84 are in contact with the upper end of each of the exhaust valves 45 from above respectively, and are in contact with each cam 67 from below. On the other hand, the remaining half the number of the rocker arms 84 come in contact with the upper end of each of the intake valves 44 from above respectively, and are in contact with each cam 72 from below. Further, HLAs 85 (hydraulic lash adjusters) are provided inside the camshaft housing 47. Each of HLAs 85 is connected to an end of each rocker arm 84. This end of each rocker arm 84 is opposite to the contacting end of each rocker arm 84, which comes into contact with the intake valves 44 or the exhaust valves 45.

As shown in FIG. 4, the timing chain 86, which is a ring member, is wound around the sprocket of the crank shaft 25, the sprocket 68 of the exhaust camshaft 65, and the sprocket 73 of the intake camshaft 70.

As shown in FIG. 1, the lower end surface of the cylinder head cover 87 is in contact with the upper end surfaces of the camshaft housing 47 and the end cam cap 80 in an air-tight and water-tight manner. In addition, the camshaft housing 47 and the cylinder head cover 87 are fixed to each other by using a bolt. Namely, the cylinder head cover 87 covers up the upper end opening of the camshaft storage space 47*a* of the camshaft housing 47.

Thus, the camshaft storage space 47*a* of the camshaft housing 47 and the interior space of the cylinder head cover 87 communicate with each other. These spaces have no communication with the external space outside of the cylinder head body 40, the camshaft housing 47, and the cylinder head cover 87. Therefore, the atmosphere pressure of each of the camshaft storage space 47*a* of the camshaft housing 47 and the atmosphere pressure of the interior space of the cylinder head cover 87 are always the same as the outside air pressure (the atmospheric pressure outside of the vehicle).

Further, as shown in FIG. 1, the cover member 88 is in contact with the front surfaces of the cylinder block 20, the cylinder head body 40, the camshaft housing 47 and the cylinder head cover 87 and the upper surface of the front portion of the oil pan 30 in an air-tight and water-tight manner. The cover member 88 is fixed to the cylinder block 20, the cylinder head body 40, the camshaft housing 47, the cylinder head cover 87, and the oil pan 30 by using bolts.

The rear surface and the bottom surface of the cover member 88 are only opened in the cover member 88.

The chain storage space 89 is formed inside the cover member 88 (see FIG. 7).

The lower end portion of the cover member 88 is connected to the upper end surface of the front portion of the oil pan 30. Namely, the lower end of the chain storage space 89 and the front end portion of the first lubricating oil storage room 31 (the crank shaft storage space 32) communicate with each other.

Figure 5:
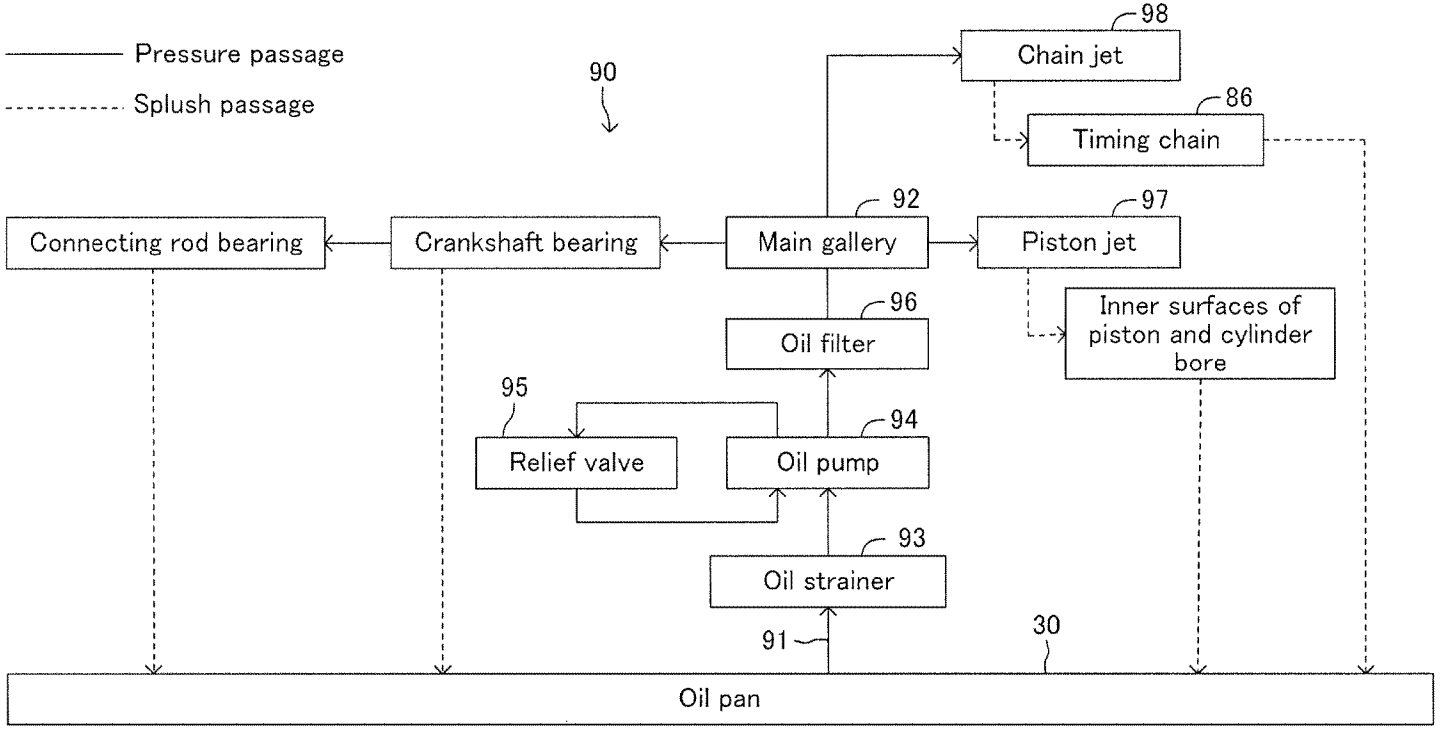
FIG. 5 is a conceptual scheme showing a first lubricating oil circulation system.
Figure 6:
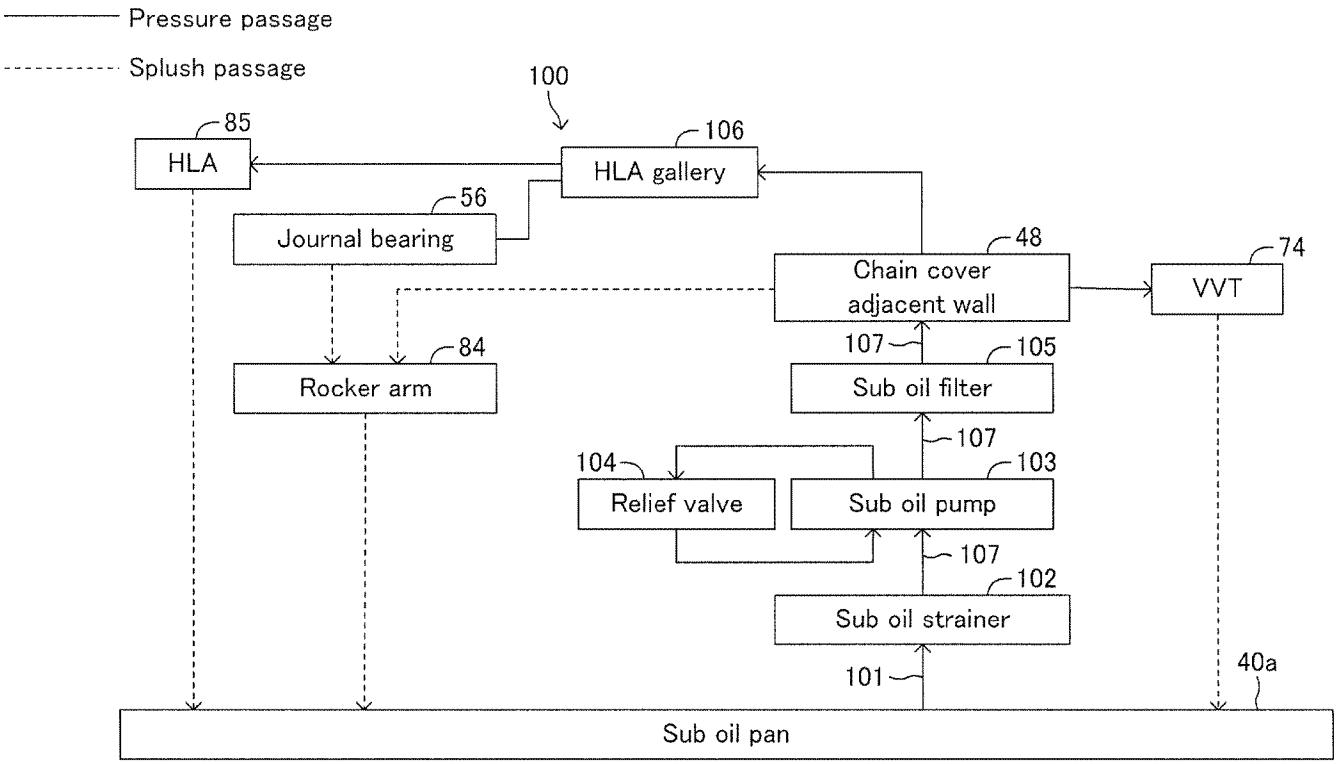
FIG. 6 is a conceptual scheme showing a second lubricating oil circulation system.

As shown in FIGS. 1, 5 and 6, the first lubricating oil circulation system 90 and the second lubricating oil circulation system 100 are formed inside the internal combustion engine 10.

As shown in FIGS. 1 and 5, the first lubricating oil circulation system 90 is provided with the oil pan 30, a first lubricating oil 91, a main gallery 92, an oil strainer 93, an oil pump 94, a relief valve 95, an oil filter 96, a piston jet 97, a chain jet 98, the crankshaft bearing, and the connecting rod bearing.

The first lubricating oil storage room 31 of the oil pan 30 is always filled with the first lubricating oil 91.

The main gallery 92 is formed inside the cylinder block 20. The main gallery 92 is a flow path of the first lubricating oil 91.

The oil strainer 93, the oil pump 94 and the oil filter 96 are disposed in the cylinder block 20. The oil strainer 93, the oil pump 94 and the oil filter 96 are connected to each other via oil paths (not shown). The oil strainer 93 is in contact with the first lubricating oil 91 in the first lubricating oil storage room 31. The oil pump 94 is interlocked with the crank shaft 25 via members including a chain (not shown). The oil pump 94 is provided integrally with the relief valve 95.

The main gallery 92 is connected to each of the crankshaft bearings and the piston jet 97. This piston jet 97 is provided in the cylinder block 20 so as to be close to the cylinder bore 21 and the piston 23. Further, the main gallery 92 is connected to the chain jet 98. This chain jet 98 is fixed to the cylinder head body 40 or the cylinder block 20. The chain jet 98 is exposed in the chain storage space 89 and is close to the timing chain 86.

As shown in FIGS. 1 and 6, the second lubricating oil circulation system 100 is provided with a sub oil pan 40*a*, a second lubricating oil 101, a sub oil strainer 102, a sub oil pump 103, a relief valve 104, a sub oil filter 105, a HLA gallery 106, and a lubricating oil passage 107.

The cylinder head body 40 is provided with the sub oil pan 40*a* that is a recess formed inside the cylinder head body 40. This the sub oil pan 40*a* is always filled with the second lubricating oil 101.

The sub oil strainer 102, the sub oil pump 103 and the sub oil filter 105 are provided inside the cylinder head body 40. The sub oil pump 103 is interlocked with the crank shaft 25 via the exhaust camshaft 65, the intake camshaft 70 and the chain or the like, and is provide integrally with the relief valve 104. Note that, the sub oil pump 103 may be an electric pump.

The sub oil strainer 102, the sub oil pump 103 and the sub oil filter 105 are connected to each other via the lubricating oil passage 107 formed inside the cylinder head body 40.

The sub oil strainer 102 is in contact with the second lubricating oil 101 in the sub oil pan 40*a*.

Furthermore, the lubricating oil passage 107 is connected to grooves (not shown) formed on the inner surfaces of the bearing recesses 52*a*, 52*b* of the chain cover adjacent wall 48. An oil passage for VVT (not shown) is formed inside the front portion of each of the exhaust camshaft 65 and the intake camshaft 70. Furthermore, the entrance end of each oil passage for VVT is formed on the surface of each of the foremost supported portions 66, 71 of the exhaust camshaft 65 and the intake camshaft 70. Each oil passage for VVT passes through the corresponding VVT 74, and further is connected to the front end of each oil passage 48*a* (see FIG. 3) that passes through the chain cover adjacent wall 48 in the forward and rearward direction and is positioned below the bearing recesses 52*a*, 52*b*. Furthermore, an oil seal is provided between a rotating portion (not shown) of each VVT 74 and the front surface of the chain cover adjacent wall 48. This oil seal prevents the second lubricating oil 101 from flowing from the camshaft storage space 47*a* to the chain storage space 89 and prevents the first lubricating oil 91 and blowby gas described below from flowing from the chain storage space 89 to the camshaft storage space 47*a*. Furthermore, the lubricating oil passage 107 is connected to one end of the HLA gallery 106 formed inside the cylinder head body 40 via the grooves formed on the inner surfaces of the bearing recess 52*a*, 52*b* of the chain cover adjacent wall 48. The HLA gallery 106 is a flow path of the second lubricating oil 101. The HLA gallery 106 is connected to the HLA 85 and the journal bearings 56.

Furthermore, as shown in FIG. 1, the internal combustion engine 10 is provided with the blowby gas circulation pipe 109 and the fresh air inlet pipe 108.

One end of the fresh air inlet pipe 108 is connected to the cover member 88, and the other end of the fresh air inlet pipe 108 is connected to the intake system 60 at a position upstream of the throttle valve 60*d*.

One end of the blowby gas circulation pipe 109 is connected to the cylinder block 20, and the other end of the blowby gas circulation pipe 109 is connected to the intake system 60 at a position downstream of throttle valve 60*d*. A valve (not shown) is provided in the blowby gas circulation pipe 109.

Further, as shown in FIG. 2, the internal combustion engine 10 is connected to a crank position sensor CS, a wheel speed sensor (not shown), an accelerator opening sensor APS, a break sensor BPS, and an electronic control unit 110.

The crank position sensor CS outputs signal every time the crank shaft 25 rotates by a predetermined angle. This signal is used to obtain rotating speed NE of the internal combustion engine 10. The rotating speed NE represents the number of rotations of the crank shaft 25 per minute.

The wheel speed sensor outputs a signal representing a rotating speed of each wheel of the vehicle. A vehicle speed SPD is acquired based on average value of the rotating speeds of the wheels.

The accelerator opening sensor APS detects an operation amount of the accelerator pedal AP operated by a driver and outputs a signal representing this operation amount.

The break sensor BPS detects an operation amount of the brake pedal BP operated by the driver and outputs a signal representing this operation amount.

The electronic control unit 110 (hereinafter it is referred to as ECU 110) is a micro-computer including a CPU 111, a ROM 112, a RAM 113, a backup RAM 114 and an interface 115, all of which are connected to each other via a bus. Data, which includes a program executed by the CPU 111, a look-up table (a map), and constants, are stored in the ROM 112 in advance so that the data are held. The RAM 113 temporarily holds data according to the instruction from the CPU 111. The backup RAM 114 holds data not only when the internal combustion engine 10 is in the driving state but also when the internal combustion engine 10 is not in the driving state. The interface 115 includes an AD converter.

The interface 115 is connected to an ignition switch (not shown), the crank position sensor CS, the wheel speed sensor, the accelerator opening sensor APS, and the break sensor BPS. Output signals of the ignition switch, the crank position sensor CS, the wheel speed sensor, the accelerator opening sensor APS, and the break sensor BPS are transmitted to the CPU 111. As is well known, the ignition switch can be switched to any one of an OFF position, an ON position and an accessory position by operating a key (not shown).

Next, the operation of the internal combustion engine 10 in accordance with the control of the ECU 110 will be described.

When the ignition switch is operated by operation of the key, the internal combustion engine 10 starts to rotate. Then, the CPU 111 sends a driving signal (instruction signal) to the igniter 46*b*, the injector 46*c*, the actuator for throttle valve 60*e*, and the actuator for VVT.

Then, an air-fuel mixture including the fuel and air is supplied from the intake system 60 to the combustion chamber 41, and this air-fuel mixture burns in the combustion chamber 41. Then, each piston 23 reciprocates in the vertical direction in the corresponding cylinder bore 21 of the cylinder block 20. Then, the movement of each piston 23 is transmitted to the crank shaft 25 through the connecting rod 24, and then the crank shaft 25 rotates about its axis. Then, since rotational force of the crank shaft 25 is transmitted to the sprocket 68 of the exhaust camshaft 65 and the sprocket 73 of the intake camshaft 70 through the timing chain 86, each of the exhaust camshaft 65 and the intake camshaft 70 rotates about its own axis. As a result, each cam 67 of the exhaust camshaft 65 rotates to move corresponding one of the rocker arms 84 upward and downward. Then, each exhaust valve 45 connected to corresponding one of the rocker arms 84 moves upward and downward to open and close each exhaust port 43. Additionally, each cam 72 of the intake camshaft 70 rotates to move corresponding one of the rocker arms 84 upward and downward. Then, each intake valve 44 connected to corresponding one of these rocker arms 84 moves upward and downward to open and close each inlet port 42.

When the CPU 111 sends a driving signal to the actuator for VVT connected to the VVT 74 provided in the exhaust camshaft 65, the driving force of the actuator for VVT causes the rotation position of the exhaust camshaft 65 (rotation phase) to change with respect to the crank shaft 25. Therefore, the valve timing (INVT) of each of the exhaust valves 45 changes to the advance angle side or the delay angle side. Likewise, when the CPU 111 sends a driving signal to the actuator for VVT connected to the VVT 74 provided in the intake camshaft 70, the driving force of this actuator for VVT causes the rotation position of the intake camshaft 70 to change with respect to the crank shaft 25. Therefore, the valve timing of each of the intake valves 44 changes to the advance angle side or the delay angle side.

Furthermore, when the crank shaft 25 rotates, this rotational force is transmitted to the oil pump 94 and the sub oil pump 103 via members including the chain, and then the oil pump 94 and the sub oil pump 103 start their suction operation.

As shown in FIG. 5, when the oil pump 94 starts its suction operation, the first lubricating oil 91 in the first lubricating oil storage room 31 of the oil pan 30 is sucked by the oil pump 94 via the oil strainer 93. Then, the first lubricating oil 91 discharged from the oil pump 94 flows to the main gallery 92 after passing through the oil filter 96.

In addition, the first lubricating oil 91 is supplied from the main gallery 92 to the crankshaft bearing. Part of the first lubricating oil 91 supplied to the crankshaft bearing returns to the oil pan 30 by gravity. The remaining first lubricating oil 91 supplied to the crankshaft bearing is supplied to the connecting rod bearing of the crank shaft 25 and returns to the oil pan 30 by gravity.

In addition, part of the first lubricating oil 91 is supplied from the main gallery 92 to the piston jet 97. Then, the piston jet 97 injects the first lubricating oil 91 to the cylinder bore 21 and the piston 23. The first lubricating oil 91 fed to the cylinder bore 21 and the piston 23 returns to the oil pan 30 by gravity.

In this way, the first lubricating oil 91 circulates through the first lubricating oil storage room 31 of the oil pan 30 and the interior space of the cylinder block 20 by the sucking force of the oil pump 94. The circulation passage of this first lubricating oil 91 is a block side first lubricating oil circulation passage 90*a* shown in FIG. 1.

Further, the first lubricating oil 91 flowing into the main gallery 92 is supplied from the main gallery 92 to the chain jet 98. Then, the chain jet 98 injects the first lubricating oil 91 to the timing chain 86. The first lubricating oil 91 supplied to the timing chain 86 returns to the oil pan 30 by gravity.

In this way, the first lubricating oil 91 in the first lubricating oil storage room 31 of the oil pan 30 circulates through the inside space of the oil pan 30, the inside space of the cylinder block 20, and the chain storage space 89 of cover member 88 by the sucking force of the oil pump 94. The circulation passage of this first lubricating oil 91 is a chain side first lubricating oil circulation passage 90*b* shown in FIG. 1.

On the other hand, as shown in FIG. 6, when the sub oil pump 103 starts its suction operation, the second lubricating oil 101 in the sub oil pan 40*a* is sucked by the sub oil pump 103 via the sub oil strainer 102 and the lubricating oil passage 107. The second lubricating oil 101 discharged from the sub oil pump 103 is supplied to the grooves of the bearing recesses 52*a*, 52*b* of the chain cover adjacent wall 48, the oil passage for VVT, and the HLA gallery 106 after passing through the lubricating oil passage 107 and the sub oil filter 105.

The second lubricating oil 101, which has lubricated the interior of each VVT 74, passes through the oil passage 48*a* of the chain cover adjacent wall 48 and returns to the sub oil pan 40*a* by gravity.

The second lubricating oil 101 supplied to the HLA gallery 106 is supplied to the HLA 85 through the HLA gallery 106. Furthermore, part of the second lubricating oil 101 supplied to the HLA 85 returns to the sub oil pan 40*a* by gravity. In addition, part of the second lubricating oil 101 supplied to the HLA gallery 106 is supplied to the inner surfaces of the bearing recesses 57*a*, 57 *b* of each of the bearing journals 56 through the HLA gallery 106.

Part of the second lubricating oil 101 supplied to the journal bearings 56 returns to the sub oil pan 40*a* by gravity. The remaining second lubricating oil 101 supplied to the journal bearings 56 is supplied to the rocker arms 84. Furthermore, the second lubricating oil 101 supplied to the rocker arms 84 returns to the sub oil pan 40*a* by gravity.

In this way, the second lubricating oil 101 in the sub oil pan 40*a* circulates through the interior of the camshaft housing 47 and the interior of the cylinder head cover 87 by the sucking force of the sub oil pump 103. The circulation passage of this second lubricating oil 101 is a second lubricating oil circulation passage 100*a* shown in FIG. 1.

As is well known, when the internal combustion engine 10 is in an operation state, part of the combustion gas generated in the combustion chamber 41 flows into the crank shaft storage space 32 after passing through a gap between the inner peripheral surface of the cylinder bore 21 and the piston ring end gaps of piston rings, which are mounted on each of the pistons 23 respectively, to become blowby gas.

Then, the blowby gas comes into contact with the first lubricating oil 91 in the first lubricating oil storage room 31 of the oil pan 30. As a result, since the blowby gas is mixed with the first lubricating oil 91, the first lubricating oil 91 is deteriorated.

On the other hand, as described above, the camshaft storage space 47*a* of the camshaft housing 47 and the recess (the combustion chamber 41) of the cylinder head body 40 have no communication with each other. Furthermore, the seal members, which are fixed to the upper portion of each of the intake valve guides 42*a* and the exhaust valve guides 43*a* respectively, cause the inlet ports 42 and the exhaust ports 43 not to communicate with the camshaft storage space 47*a*.

Therefore, the blowby gas staying in the cylinder block 20 and the oil pan 30 does not flow into the camshaft housing 47 via the recess (the combustion chamber 41), each intake valve guide 42*a* and each exhaust valve guide 43*a*. Namely, the blowby gas does not come in contact with the second lubricating oil 101 disposed inside the camshaft housing 47 and the cylinder head cover 87 via the combustion chamber 41, the intake valve guide 42*a*, and the exhaust valve guide 43*a*.

In addition, the second lubricating oil 101 in the camshaft housing 47 does not flow into the cylinder block 20 and the oil pan 30 via the combustion chamber 41, the intake valve guide 42*a*, and the exhaust valve guide 43*a*. Namely, the second lubricating oil circulation passage 100*a* and the block side first lubricating oil circulation passage 90*a* (and the chain side first lubricating oil circulation passage 90*b*) are independent from each other.

By the way, the blowby gas in the crank shaft storage space 32 and the chain storage space 89 flows into the combustion chamber 41 via the blowby gas circulation pipe 109 and the intake system 60*a* to be burned in the combustion chamber 41.

On the other hand, fresh air (which excludes exhaust gas and fuel) flowing from the upstream side of the intake duct 60*c* to the downstream side of the intake duct 60*c* is always supplied to the chain storage space 89 and the crank shaft storage space 32 via the fresh air inlet pipe 108.

Thus, a negative pressure is always applied to the chain storage space 89 of the cover member 88 and the inside of the cylinder block 20. Therefore, the atmosphere pressure of the chain storage space 89 is always lower than those of the camshaft storage space 47*a* of the camshaft housing 47 and the interior space of the cylinder head cover 87 (i.e., the outside air pressure or the atmospheric pressure outside of the vehicle). Since there is a difference in atmosphere pressure between the camshaft storage space 47*a* of the camshaft housing 47 and the chain storage space 89, if there is a gap that makes the camshaft storage space 47*a* and the chain storage space 89 communicate with each other therebetween, a sucking force heading to the chain storage space 89 is always applied to the second lubricating oil 101.

However, the spaces (the cross-sectional area gradually changing gaps S) between the left and right gap forming surfaces 83 of the end cam cap 80 and the left and right side surfaces 51*b* of the recess for cam cap 51 are filled with the gasket G in an air-tight and water-tight manner. Furthermore, the space between the bottom surface of the end cam cap 80 and the bottom surface 51*a* of the recess for cam cap 51 is also filled with the gasket G in an air-tight and water-tight manner.

Then, the second lubricating oil 101 in the camshaft storage space 47*a* does not pass through a gap between the end cam cap 80 and the recess for cam cap 51 to leak to the chain storage space 89. Then, the second lubricating oil 101 in the camshaft storage space 47*a* does not mix with the first lubricating oil 91.

Then, the second lubricating oil 101 in the camshaft storage space 47*a* does not decrease.

The bottom surface of the end cam cap 80 and the bottom surface 51*a* of the recess for cam cap 51 are substantially parallel to each other. In other words, the cross-sectional area of the gap between the bottom surface of the end cam cap 80 and the bottom surface 51*a* of the recess for cam cap 51 is substantially constant at any position in the forward and rearward direction. Namely, the cross-sectional area of the gap between the front end portion of the bottom surface of the end cam cap 80 and the front end portion of the bottom surface 51*a* of the recess for cam cap 51 is substantially the same as the cross-sectional area of the gap formed between a remaining portion of the bottom surface of the end cam cap 80, which excludes the front end portion of the bottom surface of the end cam cap 80, and a remaining portion of the bottom surface 51*a* of the recess for cam cap 51, which excludes the front end portion of the bottom surface 51*a*.

Then, the front end portion of the bottom surface of the end cam cap 80 and the front end portion of the bottom surface 51*a* of the recess for cam cap 51 may hardly generate a resistance force to prevent the gasket G positioned between the bottom surface of the end cam cap 80 and the bottom surface 51*a* of the recess for cam cap 51 from moving to the chain storage space 89 when the negative pressure in the chain storage space 89 is exerted on the gasket G. This problem occurs when the end cam cap 80 and the recess for cam cap 51 are not tightly fixed by using the bolts and each of the female screw holes 53. Then, in this case, there is a slight possibility of the gasket G being discharged to the chain storage space 89 via the gap between the front end portion of the bottom surface of the end cam cap 80 and the front end portion of the bottom surface 51*a*.

However, in the present embodiment, the gasket G is sandwiched between the bottom surface of the end cam cap 80 and the bottom surface 51*a* of the recess for cam cap 51 with a strong force by using the bolts and each of the female screw holes 53. Therefore, the gasket G is not discharged to the chain storage space 89 via the gap between the front end portion of the bottom surface of the end cam cap 80 and the front end portion of the bottom surface 51*a*.

Furthermore, the negative pressure in the chain storage space 89 is also exerted on the gasket G that is semi-solidified in the left and right cross-sectional area gradually changing gaps S.

However, the cross-sectional area of each of the cross-sectional area gradually changing gaps S gradually decreases as approaching from the rear end of each of the cross-sectional area gradually changing gaps S to the front end of each of the cross-sectional area gradually changing gaps S.

Then, the front end portions of the side surfaces of the end cam cap 80 and the front end portions of the side surfaces 51*b* of the recess for cam cap 51 generate a large resistance force to prevent the gasket G from moving to the chain storage space 89.

Therefore, the gasket G does not pass through the front end portion of each of the cross-sectional area gradually changing gaps S and is not discharged to the chain storage space 89.

The left and right side surfaces of the end cam cap 80 may be constituted by flat surfaces parallel to the left and right side surfaces 51*b* of the recess for cam cap 51.

In this case, however, the same problem as the above problem on the bottom surface of the end cam cap 80 and the bottom surface 51*a* of the recess for cam cap 51, which occurs when the bolts are not threaded to each of the female screw holes 53, occurs. Namely, a chance that the semi-solidified gasket G is discharged to the chain storage space 89 via the gap between the left and right side surfaces of the end cam cap 80 and the left and right side surfaces 51*b* of the recess for cam cap 51 becomes larger compared with the case where the cross-sectional area gradually changing gaps S are formed between the end cam cap 80 and the recess for cam cap 51.

In contrast, in the present embodiment, since the cross-sectional area gradually changing gaps S are formed between the left and right gap forming surfaces 83 of the end cam cap 80 and the left and right side surfaces 51*b* of the recess for cam cap 51, such a problem does not occur.

Thus, in the internal combustion engine 10, the second lubricating oil 101 in the camshaft storage space 47*a* of the camshaft housing 47 and the interior space of the cylinder head cover 87 does not flow into the cylinder block 20 and the oil pan 30, and then does not leak to the chain storage space 89.

Therefore, the amount of the second lubricating oil 101 in the camshaft storage space 47*a* of the camshaft housing 47 and the interior space of the cylinder head cover 87 does not decrease.

Then, the intake valves 44, the exhaust valves 45, the exhaust camshaft 65, the intake camshaft 70, the rocker arms 84, and the HLAs 85 can always operate smoothly.

Noted that, a gap forming surface, which is constituted by an inclined surface corresponding to the gap forming surface 83, may be formed on the bottom surface of the end cam cap 80, and then a cross-sectional area gradually changing gap S having a triangular shape in a side view may be formed between the bottom surface of the end cam cap 80 and the bottom surface 51*a* of the recess for cam cap 51. In this case, this cross-sectional area gradually changing gap S is filled with the gasket G.

However, in this case the bottom surface 51*a* of the recess for cam cap 51 supports the end cam cap 80 unstably.

On the other hand, in the present embodiment, since the bottom surface of the end cam cap 80, which is a horizontal flat surface, is supported by the bottom surface 51*a* of the recess for cam cap 51, which is a horizontal flat surface, such a problem does not occur.

Furthermore, in the internal combustion engine 10, the end cam cap 80 is disposed in the recess for cam cap 51 formed in the chain cover adjacent wall 48 of the camshaft housing 47. In other words, the cover adjacent wall 48 and the end cam cap 80 are disposed at the same position in the forward and rearward direction.

Therefore, compared with a conventional internal combustion engines, the present invention can reduce the forward and rearward direction dimensions of the camshaft housing 47 and the entire internal combustion engine 10.

Although, the present invention has been described based on the above embodiment. However, the present invention is not limited to the above embodiment, and various modifications are possible without departing from the object of the present invention.

Figure 8:
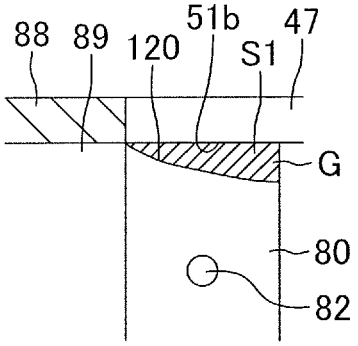
FIG. 8 is a cross-sectional view corresponding to principal components of the internal combustion engine, which are shown in FIG. 7, according to a first modified embodiment of the present invention.
Figure 9:
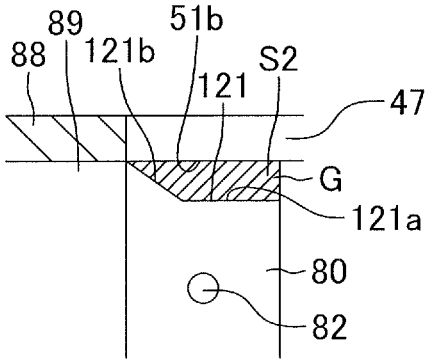
FIG. 9 is a cross-sectional view similar to that of FIG. 8 according to a second modified embodiment of the present invention.
Figure 10:
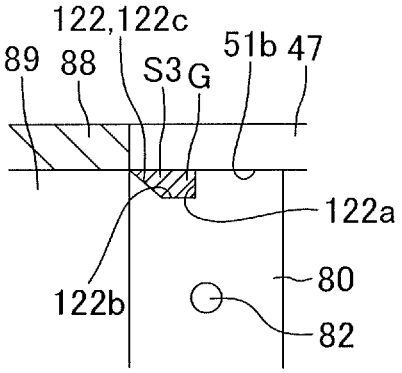
FIG. 10 is a cross-sectional view similar to that of FIG. 8 according to a third modified embodiment of the present invention.

For example, FIGS. 8 through 10 show first through third modified embodiments of the present invention, respectively.

In the first modified embodiment shown in FIG. 8, the left and right side surfaces of the end cam cap 80 are constituted by gap forming surfaces 120 that are curved surfaces and gradually approach the center portion of the end cam cap 80 as approaching from the front thereof to the rear thereof in the plane view. In other words, the left and right side portions of the end cam cap 80 are cut out (notched) so as to form the gap forming surfaces 120, respectively.

In the second modified embodiment shown in FIG. 9, the left and right side surfaces of the end cam cap 80 are constituted by gap forming surfaces 121. Each of the gap forming surfaces 121 comprises a flat surface 121*a* and a flat surface 121*b*. Each of flat surfaces 121*a* extends linearly in the forward and rearward direction from the rear surface of the end cam cap 80 to the front thereof in the plane view. Each of flat surfaces 121*b* extends linearly from the front end of the corresponding flat surface 121*a* to the side end of the front surface of the end cam cap 80 while inclining with respect to the forward and rearward direction. Namely, the left and right side portions of this end cam cap 80 are cut out (notched) so as to form the gap forming surfaces 121, respectively.

In the third modified embodiment shown in FIG. 10, the front portion of each of the left and right side surfaces of the end cam cap 80 is constituted by a gap forming surface 122, respectively. Each of the gap forming surfaces 122 comprises a flat surface 122*a*, a flat surface 122*b*, and a flat surface 122*c*. Each of flat surfaces 122*a* extends linearly in the lateral direction from the side surface of the end cam cap 80 in the plane view. Each of flat surfaces 122*b* extends linearly from the inner end of the corresponding flat surface 122*a* to the front. Each of flat surfaces 122*c* extends linearly from the front end of the corresponding flat surface 122*b* to the side end of the front surface of the end cam cap 80 while inclining with respect to the forward and rearward direction. Namely, the left and right side portions of this end cam cap 80 are cut out (notched) so as to form the gap forming surfaces 122, respectively.

In each of the modified embodiments shown in FIGS. 8 through 10, the cross-sectional area gradually changing gaps S1, S2, and S3, whose shapes are different from each other, are formed between each of the gap forming surfaces 120, 121, 122 of the end cam caps 80 and each of the side surfaces 51*b* of each recess for cam cap 51, respectively. The gaps between the left and right side surfaces of each of the end cam caps 80 and the left and right side surfaces 51*b* of each recess for cam cap 51 are filled with the gasket G. The gap between the bottom surface of each of the end cam caps 80 and the bottom surface 51*a* of each recess for cam cap 51 is filled with the gasket G. In these modified embodiments as well, the gaskets G, which are between the left and right side surfaces of each end cam cap 80 and the left and right side surfaces 51*b* of each recess for cam cap 51, and the gasket G, which is between the bottom surface of each end cam cap 80 and the bottom surface 51*a* of each recess for cam cap 51, are continuous with each other.

Furthermore, the cross-sectional area of the cross-sectional area gradually changing gap S1 of the first modified embodiment, which is formed by cutting this cross-sectional area gradually changing gap S1 with a plane orthogonal to the forward and rearward direction, is gradually reduced as approaching from the rear thereof to the front thereof (i.e., the front surface of the end cam cap 80). In addition, the cross-sectional area of the cross-sectional area gradually changing gap S2 of the second modified embodiment, which is formed by cutting this cross-sectional area gradually changing gap S2 with a plane orthogonal to the forward and rearward direction, is gradually reduced as approaching from the front end of the flat surface 121*a* to the front thereof. Furthermore, the cross-sectional area of the cross-sectional area gradually changing gap S3 of the third modified embodiment, which is formed by cutting this cross-sectional area gradually changing gap S3 with a plane orthogonal to the forward and rearward direction, is gradually reduced as approaching from the front end of the flat surface 122*b* to the front thereof.

Therefore, each of these modified embodiments can produce the same effect as that of the above embodiment.

Figure 11:
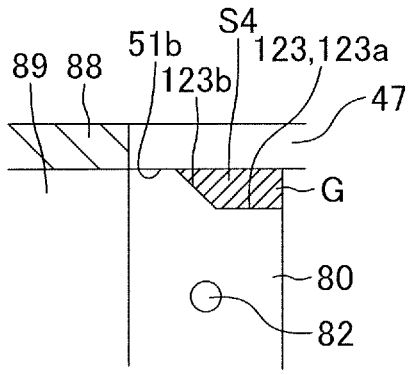
FIG. 11 is a cross-sectional view similar to that of FIG. 8 according to a fourth modified embodiment of the present invention.

In the fourth modified embodiment shown in FIG. 11, the rear portion of each of the left and right side surfaces of the end cam cap 80 is constituted by a gap forming surface 123. Each of the gap forming surfaces 123 comprises a flat surface 123*a* and a flat surface 123*b*. Each of flat surfaces 123*a* extends linearly from the rear surface of the end cam cap 80 to the front in the plane view. Each of flat surfaces 123*b* extends linearly from the front end of the corresponding flat surface 123*a* to a middle portion of each of side surfaces of the end cam cap 80 in the forward and rearward direction while inclining with respect to the forward and rearward direction. Namely, the left and right side portions of this end cam cap 80 are cut out (notched) so as to form the gap forming surfaces 123, respectively. The front portion of each of the left and right side surfaces of the end cam cap 80 is constituted by a flat surface parallel to the side surfaces 51*b* of the recess for cam cap 51.

In this modified embodiment, each of the cross-sectional area gradually changing gaps S4 formed between the gap forming surfaces 123 and the side surfaces 51*b* are filled with the gasket G, respectively. Furthermore, a gap between the bottom surface of the end cam cap 80 and the bottom surface 51*a* of the recess for cam cap 51 is filled with the gasket G. In this modified embodiment as well, the gaskets G, which are between the left and right side surfaces of the end cam cap 80 and the left and right side surfaces 51*b* of the recess for cam cap 51, and the gasket G, which is between the bottom surface of the end cam cap 80 and the bottom surface 51*a* of the recess for cam cap 51, are continuous with each other.

The gasket G filled in the front portion of each of the cross-sectional area gradually changing gaps S4 receives the negative pressure from the chain storage space 89.

However, in this modified embodiment, the front portion of each of left and right side surfaces of the end cam cap 80 and the front portion of each of side surfaces 51*b* faces with each other so as to form a minute gap and be parallel to each other. No gasket G is filled in a gap between the front portion of each of the left and right side surfaces of the end cam cap 80 and the front portion of each of side surfaces 51*b*.

Then, the gasket G filled in the front portion of each of the cross-sectional area gradually changing gaps S4 hardly move to the gap between the front portion of each of left and right side surfaces of the end cam cap 80 and the front portion of each of the side surfaces 51*b*. Namely, there is an extremely small possibility that the gasket G is discharged to the chain storage space 89 after passing through the gap between the front portion of each of the left and right side surfaces of the end cam cap 80 and the front portion of each of side surfaces 51*b*. Therefore, a chance that the second lubricating oil 101 in the interior spaces of the camshaft storage space 47*a* and the cylinder head cover 87 leaks to the chain storage space 89 after passing through the gaps between the side surfaces of the end cam cap 80 and the side surfaces 51*b* of the recess for cam cap 51 is much smaller compared with the case where the front end portion of each of the cross-sectional area gradually changing gaps S4 is positioned at the same position as the front surface of the end cam cap 80.

Both side surfaces of each of the end cam caps 80 may be constituted by flat surfaces that are parallel to each other and the both side portions of each recess for cam cap 51 may be cut out (notched) so that the both side surfaces of each recess for cam cap 51 and the both side surfaces of each of the end cam caps 80 form each of the cross-sectional area gradually changing gaps S, S1, S2, S3, S4 therebetween, respectively.

The internal combustion engine 10 may comprise an annular timing belt (an annular interlocking member) that interlocks the crank shaft 25, the exhaust camshaft 65, and the intake camshaft 70 each other instead of the timing chain 86.

The internal combustion engine 10 may be configured so that the intake valves 44 and the exhaust valves 45 are opened and closed by one camshaft.

Figure 12:
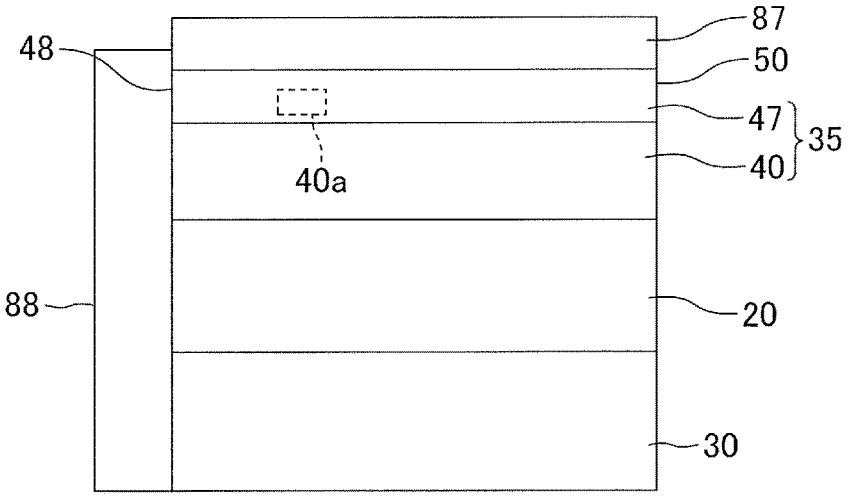
FIG. 12 is a view similar to that of FIG. 1 according to a fifth modified embodiment of the present invention.
Figure 13:
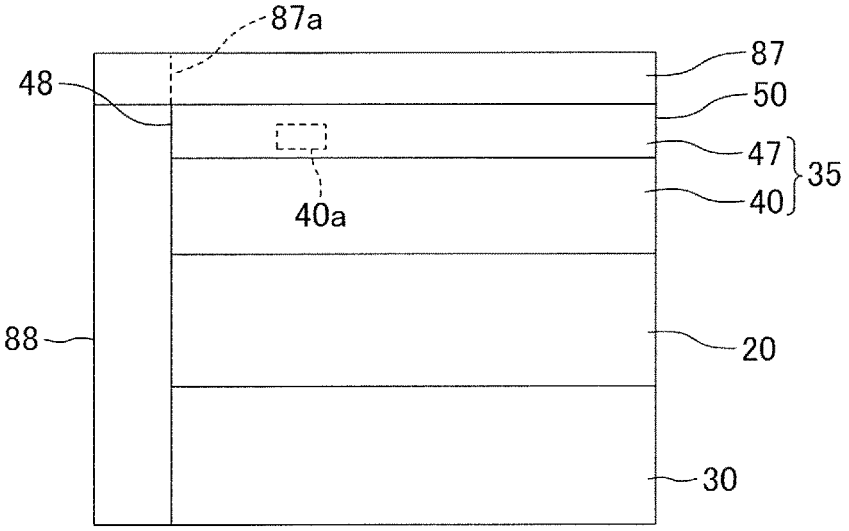
FIG. 13 is a view similar to that of FIG. 12 according to a sixth modified embodiment of the present invention.

The internal combustion engine 10 may be configured as the fifth modified embodiment shown in FIG. 12 or the sixth modified embodiment shown in FIG. 13.

The cover member 88 of the internal combustion engine 10 in FIG. 12 is opened only at its rear surface and the front surface of the oil pan 30 is opened. The lower portion of the rear surface of the cover member 88 is fixed to the front surface of the oil pan 30, and the lower opening of the rear surface of the cover member 88 is connected to the opening of the front surface of the oil pan 30.

The cover member 88 of the internal combustion engine 10 in FIG. 13 is opened only at its rear surface and upper surface. The upper surface of the cover member 88 is fixed to the front portion of the opened lower surface of the cylinder head cover 87. As shown in FIG. 13, a partition wall 87*a* is provided inside the cylinder head cover 87. A rubber gasket (not shown) is provided between the upper surface of the end cam cap 80 and the lower surface of the partition wall 87*a*. Therefore, the blowby gas, the first lubricating oil 91, and the second lubricating oil 101 do not flow between the space at a more forward portion of the cylinder head cover 87 than the partition wall 87*a* (and the upper space of the cover member 88) and the space at a more rearward portion of the cylinder head cover 87 than the partition wall 87*a*.

What is claimed is:

1. An internal combustion engine comprising:

a cylinder block including a cylinder bore which supports a piston so as to be slidable;

an oil pan provided therein with a crank shaft storage space for storing a crank shaft rotating in conjunction with an operation of said piston, said oil pan connected to said cylinder block;

a cylinder head provided therein with a port, which is communicated with said cylinder bore and made to be opened and closed by a valve reciprocating in conjunction with said operation of said piston, a sub oil pan, and a camshaft storage space, which has no communication with an interior of said oil pan, said crank shaft storage space, and said cylinder bore;

a camshaft disposed in said camshaft storage space, said camshaft including a plurality of supported portions whose lower portions are rotatably supported by said cylinder head so that said camshaft rotates about its own axis to reciprocate said valve, said supported portions arranged at an interval in an axial direction of said camshaft;

a plurality of cam caps, fixed to said cylinder head, for rotatably supporting upper portions of said supported portions of said camshaft;

a cover member connected to said oil pan and said cylinder head so that said cover member is provided therein with an interlocking member storage space, said interlocking member storage space storing an annular interlocking member interlocking said crank shaft and said camshaft, said interlocking member storage space having communication with said crank shaft storage space and having no communication with said camshaft storage space;

a first lubricating oil filled in said oil pan so as to circulate through said interior of said oil pan, said crank shaft storage space, said cylinder bore and said interlocking member storage space;

a second lubricating oil filled in said sub oil pan so as to circulate through said an interior of said sub oil pan and said camshaft storage space; and a cover adjacent wall for forming part of said cylinder head and for separating said interlocking member storage space from said camshaft storage space;

wherein, atmosphere pressure of said interlocking member storage space is kept lower than atmosphere pressure of said camshaft storage space, a recess for cam cap is formed on an upper end surface of said cover adjacent wall so as to penetrate through said cover adjacent wall in said axial direction of said camshaft, one of said plurality of said cam caps, which is disposed in said recess for cam cap and is located closest to said cover member among said cam caps, is an end cam cap, said end cam cap is provided with a pair of side surfaces which are spaced from each other in a direction orthogonal to said axial direction, said side surfaces of said end cam cap and a pair of side surfaces of said recess for cam cap form two cross-sectional area gradually changing gaps therebetween, wherein each of said cross-sectional area gradually changing gaps has both open ends which are separated from each other in said axial direction and each of said cross-sectional area gradually changing gaps has a cross-sectional area which gradually decreases as approaching to said interlocking member storage space from an intermediate portion thereof in said axial direction or a portion thereof farther from said interlocking member storage space than said intermediate portion in said axial direction, a gasket is filled between an inner surface of said recess for cam cap and an outer surface of said end cam cap, wherein said inner surface includes said side surfaces of said recess for cam cap and said outer surface includes said side surfaces of said end cam cap.

2. The internal combustion engine according to claim 1, wherein, an interlocking member storage space side end of each of said cross-sectional area gradually changing gaps is located closer to said camshaft storage space than an interlocking member storage space side surface of said cover adjacent wall, said side surfaces of said end cam cap and said side surfaces of said recess for cam cap are flat surfaces, each of said side surfaces of said end cam cap and each of said side surfaces of said recess for cam cap face each other so as to form a minute gap therebetween and be parallel to each other at a position between each of said cross-sectional area gradually changing gaps and said interlocking member storage space.

3. The internal combustion engine according to claim 1, wherein, a bottom surface of said recess for cam cap and a bottom surface of said end cam cap are horizontal flat surfaces.

4. The internal combustion engine according to claim 1, wherein, a cutout is formed on each of said side surfaces of said end cam cap, each of said cutouts and each of said side surfaces of said recess for cam cap form said cross-sectional area gradually changing gap therebetween when said end cam cap is disposed in said recess for cam cap.

* * * * *